United States Patent [19]

Raven

[11] Patent Number: 5,020,037

[45] Date of Patent: May 28, 1991

[54] ALARM PILL BOX

[76] Inventor: Malcolm R. Raven, 6756 Bridlewood St., Boca Raton, Fla. 33433

[21] Appl. No.: 301,530

[22] Filed: Jan. 26, 1989

[51] Int. Cl.[5] ..... G04B 47/00; G07F 11/00

[52] U.S. Cl. ..... 368/10; 368/250; 221/2

[58] Field of Search ..... 368/10, 107–113, 368/250, 251; 340/309.1, 309.4; 221/2, 3, 15

[56] References Cited

U.S. PATENT DOCUMENTS

| | | | |
|---|---|---|---|
| 3,033,355 | 5/1962 | Van Sickle | 206/42 |
| 4,382,688 | 5/1983 | Machamer | 368/10 |
| 4,419,016 | 12/1983 | Zoltan | 368/10 |
| 4,490,711 | 12/1984 | Johnston | 340/309.4 |
| 4,588,303 | 5/1986 | Wirtschafter et al. | 368/10 |
| 4,626,105 | 12/1986 | Miller | 368/10 |

FOREIGN PATENT DOCUMENTS 2179919 3/1987 United Kingdom .

*Primary Examiner*—Vit W. Miska
*Attorney, Agent, or Firm*—Joseph Scafetta, Jr.

[57] ABSTRACT

An alarm pill box (11) has an alarm cancelled by the opening of a lid (12) to provide access to at least one medication compartment (16,17). An electronic memory is responsive to the cancellation of the alarm and records each cancellation. An associated indicator display (23) provides a visual indication of each record. Additionally, or alternatively, timer adjustment controls are inactive to adjust instant or alarm times when the lid (12) is closed, thereby requiring the lid (12) to be open in order to adjust the times.

3 Claims, 2 Drawing Sheets

FIG. 4
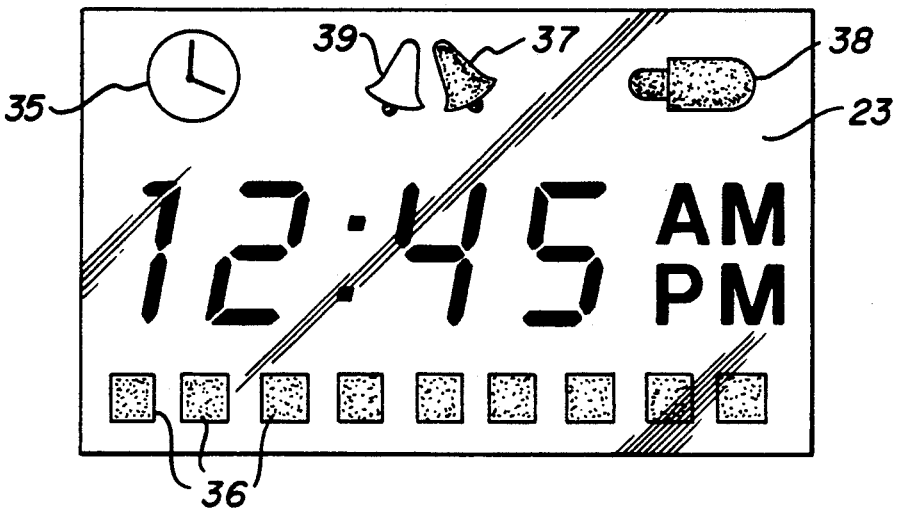
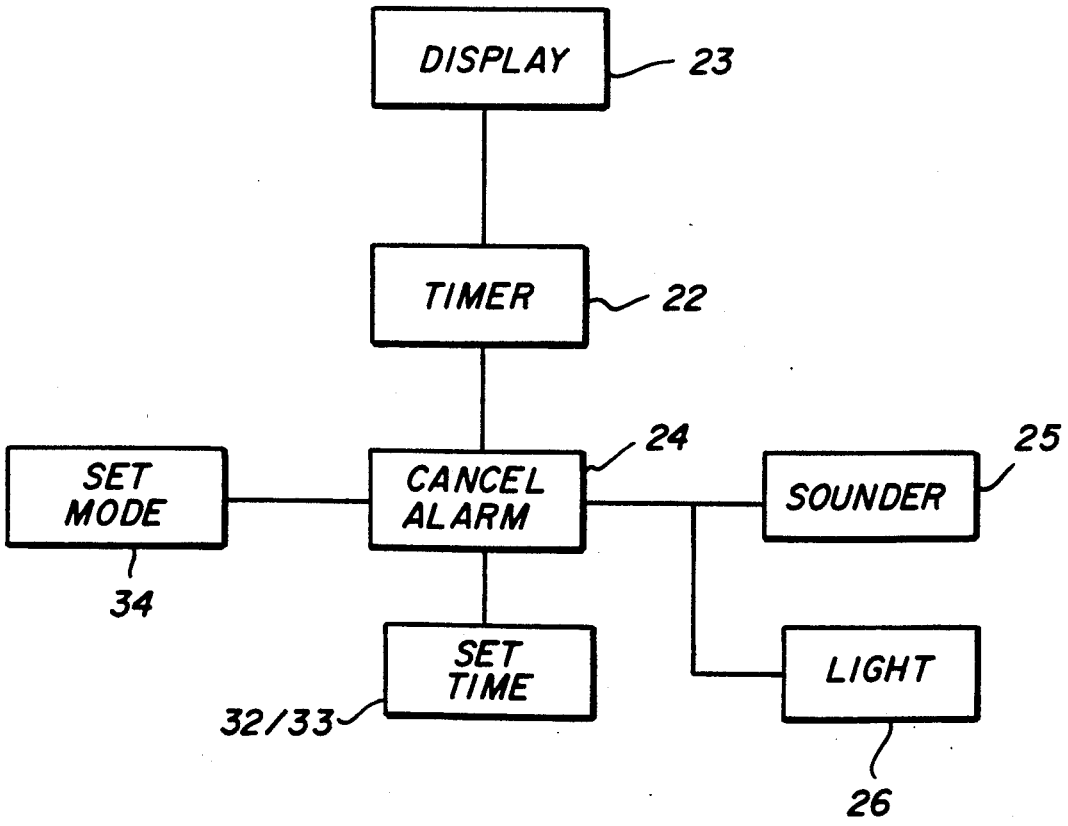
FIG. 5

ALARM PILL BOX

CROSS-REFERENCE TO RELATED APPLICATION

This application relates to an improvement made upon the subject matter disclosed in the applicant's own earlier U.S. patent application Ser. No. 06/905,420, now abandoned.

BACKGROUND OF THE INVENTION

1. Field of the Invention

This invention relates to a medication container of such dimensions as to permit it to be carried readily on the person e.g. in a pocket or handbag.

2. Description of the Related Art

Many people need to take medication at regular intervals and must have a supply readily available and must remember, or be reminded, when the time comes to take the medication. It is known to provide a medication container which incorporates an alarm operated by a timer. For example, U.S. Pat. No. 4,382,688 of Machamer discloses a timed medication container comprising a case and a lid hinged thereto for movement between open and closed positions. A time-operated alarm is provided including a cancel ing switch actuated by release of a latching membe which normally retains the lid in its closed position. When the alarm is sounded, it continues until cancelled by opening of the lid, thereby releasing the latching member and actuating the cancelling switch. Although it is envisaged that the alarm could be set to sound several times each day, the container primarily is intended for use with birth control pills and the like medication requiring administration at daily or greater intervals.

GB application No. 2179919 of Raven discloses a timed medication container similar to that of U.S. Pat. No. 4,382,688 but intended primarily for use with medication requiring administration several times a day. In this container, the alarm cancellation switch can be actuated by movement of the lid relative to the cover and a manually operable switch can be provided for single or multiple deferment or repetition of the alarm.

These prior art timed medication containers are not entirely satisfactory in that confused or infirm patients are often uncertain as to when they last took their medication. Further, such uncertainty also can arise when a patient anticipates the programmed dosage regimen and opens the container to take medication in advance of the relevant alarm signal. Accordingly, it is an object of the present invention to improve these containers to provide a clear and unambiguous record of each opening of the container during a programmed alarm sequence.

It is another object of the invention to improve timed medication containers by preventing accidental adjustment of the instant or alarm settings of the timer.

SUMMARY OF THE INVENTION

In one aspect, the present invention provides in a timed medication container comprising:

a hand-held portable case having at least one medication compartment therein;

a lid hingedly connected to said case for manual movement between an open position providing access to the said compartment and a closed position denying access to said compartment;

an electronic timer programmable to provide a sequence of alarm signals at variable intervals;

manually operable switch means connected to said timer for setting instant and alarm times thereof;

alarm means responsive to said alarm signals, an alarm cancelling switch responsive to opening of the lid to cancel an ongoing alarm signal; and display means for displaying information from said electronic timer; the improvement consisting in that the container further comprises:

electronic memory means responsive to said alarm cancelling switch to record each cancellation of an alarm signal in said programmable sequence; and indicator means included in said display means and responsive to said electronic memory means to provide a visual indication of said record.

In another aspect, the invention provides in a timed medication container comprising:

a hand-held portable case having at least one medication compartment therein;

a lid hingedly connected to said case for manual movement between an open position providing access to the said compartment and a closed position denying access to said compartment;

an electronic timer programmable to provide a sequence of alarm signals at variable intervals;

manually operable switch means mounted externally of the container and connected to said timer to set instant and alarm times thereof;

alarm means responsive to said alarm signals.

an alarm cancelling switch responsive to opening of the lid to cancel an ongoing alarm signal; and display means for displaying information from said electronic timer, the improvement consisting in that the container further comprises:

electrical circuit means interconnecting said alarm cancellation switch, said electronic timer, and said switch means to prevent adjustment of the timer by said switch means when the lid is in its closed position.

In a third aspect, the invention provides in a timed medication container comprising:

a hand-held portable case having at least one medication compartment therein;

a lid hingedly connected to said case for manual movement between an open position providing access to the said compartment and a closed position denying access to said compartment;

an electronic timer programmable to provide a sequence of alarm signals at variable intervals;

manually operable switch means mounted externally of the container and connected to said timer to set instant and alarm times thereof;

alarm means responsive to said alarm signals.

an alarm cancelling switch responsive to opening of the lid to cancel an ongoing alarm signal; and display means for displaying information from said electronic timer;

the improvement consisting in that the container further comprises:

electronic memory means responsive to said alarm cancelling switch to record each cancellation of an alarm signal in said programmable sequence;

indicator means included in said display means and responsive to said electronic memory means to provide a visual indication of said record; and electrical circuit means interconnecting said alarm cancellation switch, said electronic timer, and said switch means when the lid is in its closed position.

Usually, the alarm means will provide an audible alarm but other types of alarm, for example optical or vibratory, can be used instead of, or in addition to an audible alarm.

The lid preferable is strongly resiliently urged towards its closed position, in order to maintain the container firmly closed. If required, latching or locking means can be provided to maintain the lid in its closed position. Advantageously, such latching or locking means are made "child-proof", e.g. by the provision of a movable latch or lock member requiring relatively complex motions and/or requiring adult manual strength to move them.

The display means preferable is an LCD or similar display. Suitably it will display in its normal mode the instant time, preferably in digital form. Advantageously, the instant time display includes a symbol, especially a diagrammatic representation of an analogue clock face, indicating that the display means is in its instant time mode. The display means preferably also has a sequence of alarm modes selected by manually operable mode-selection means, usually a push button. In each alarm mode, the selected alarm time is displayed together with a symbol, suitably a diagrammatic representation of a bell indicating that the display means is in an alarm mode. An additional symbol, for example a diagrammatic representation of a capsule, can be provided to indicate, in the alarm mode, that the alarm time has been set.

In the first and third aspect of the invention, the display means includes indicator means recording each cancellation of an alarm in the programmed alarm sequence Suitably, the indicator is a series of symbols, for example squares, other geometrical shapes or numerals, which are sequentially, or preferably accumulatively, displayed after each respective ongoing alarm signal of the programmed sequence has been cancelled. Advantageously, these symbols also will be displayed in the respective alarm mode of the display means in order to indicate the position in the programmed sequence of the alarm to which the display relates.

In the second and third aspects of the invention, the manually operable switch means for setting the electronic timer are provided externally of the container. Usually, said means will be a bank of two or more switches located on the lid but it can be located on the case. Suitably, said bank, or the individual switches thereof, are at least partially recessed into the lid or case in order to limit the extent to which they protrude therefrom. In order to prevent accidental adjustment of the timer when the closed container is being handled. circuit means are provided interconnecting said switch means, the alarm cancellation switch, and the electronic timer to render the switch means inactive for adjustment of the timer when the lid in its closed position. However, when the lid is in its closed position the switch means can serve an alternative function, such as switching the display means between the various modes. Additionally, or alternatively, the switch means can act, when the lid is in its closed position, to provide for single or multiple deferment or repetition of the alarm. However, it is essential that the alarm signal cannot be cancelled unless and until the lid has been opened to provide access to the medication compartment(s) of the case.

BRIEF DESCRIPTION OF THE DRAWINGS

In order that the nature of the invention may be readily ascertained, a presently preferred embodiment of a timed medication container in accordance therewith is hereinafter particularly described with reference to the figures of the accompanying drawings, wherein:

FIG. 4 is a plan view of the visual display of the container of FIG. 1 showing all of the available symbols; and FIG. 5 is a block diagram of the electrical components of the container of FIG. 1.

DETAILED DESCRIPTION OF THE PREFERRED EMBODIMENT

Figure 1:
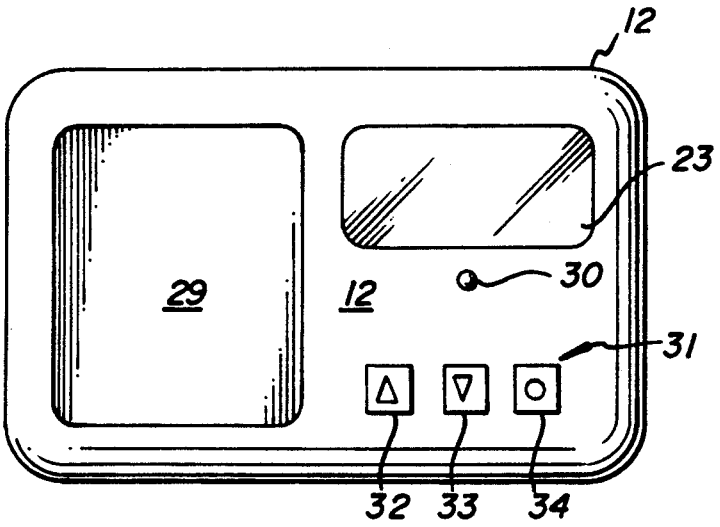
FIG. 1 is a plan view of a presently preferred container of the invention, seen in the closed position.
Figure 2:
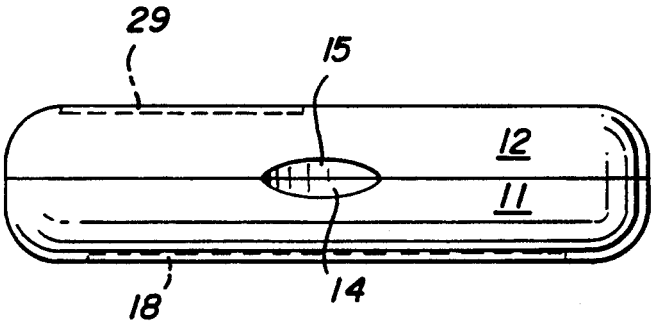
FIG. 2 is a front elevation view of the container of FIG. 1, also in the closed position.
Figure 3:
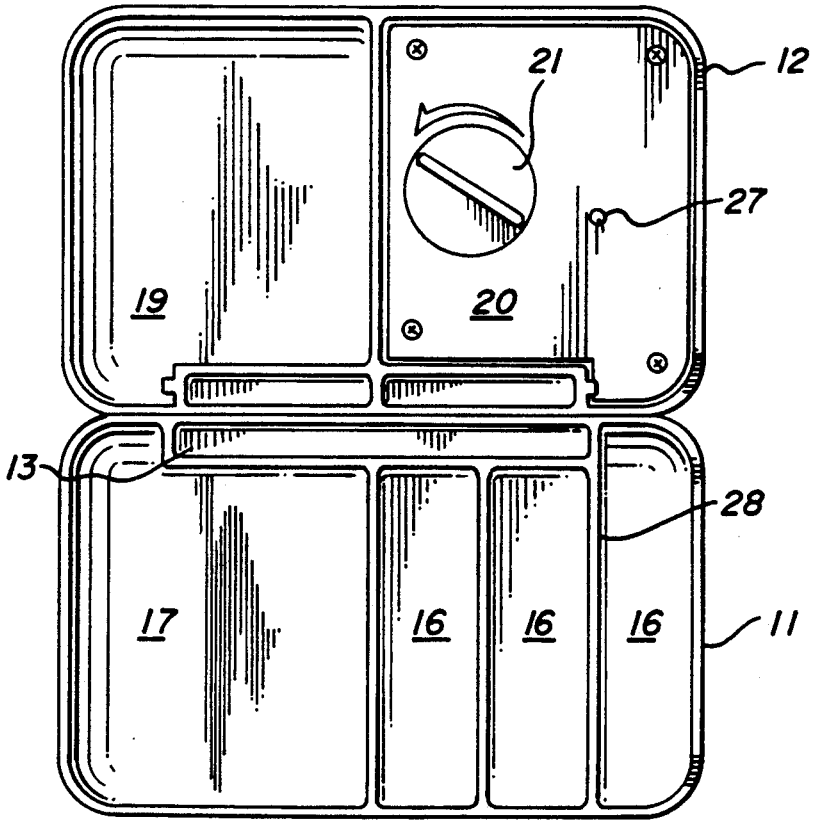
FIG. 3 is a plan view of the container of FIG. 1, seen in the opened position.

Referring to FIGS. 1–3, a timed medication container in accordance with the presently preferred embodiment of the invention comprises a case 113 and lid 12 hinged to the case 11 by a hinge 13 (FIG. 3 only) which strongly biasses the lid 12 into its closed position. Complementary finger nail-receiving recesses 14, 15 are provided in the adjacent front edges of the case 11 and lid 12 to facilitate opening of the lid 12.

The case 11 has three small compartments 16 and a large compartment 17 shown in FIG. 3 and is provided with a shallow surface recess 18 to receive a label. The lid 12 has a compartment 19 complementary to compartment 17 and an enclosed compartment 20 incorporating a cover 21 that provides access for replacement of a battery within the enclosed compartment 20. Compartment 20 also contains the electrical components of the container, including, as shown in FIG. 5, an electronic timer 22, an LCD display unit 23 an alarm cancellation switch 24, an audible alarm 25, a visual alarm 26, and associated, electrical circuitry. As shown in FIG. 3, the alarm cancellation switch 24 incorporates a push button 27 which extends through the inner wall of the compartment 20 in a position aligned with a wall 28 separating two of the compartments 16 so that, as the lid 12 is closed, abutment of the push button 27 with the wall 28 depresses the push button 27. Conversely, upon opening the lid 12, the push button 27 is released. When an alarm is ongoing, release of the push button 27 upol opening the lid 12 cancels the alarm.

As shwon in FIG. 2, the lid 12 has a shallow label recess 29 in its outer surface. The outer surface also incorporates as shwon in FIG. 1, a window for the LCD display unit 23, an indicator lamp 30 of the visual alarm, and a bank 31 of three partially recessed push button switches 32, 33 and 34. The LCD display is described in detail below. The indicator lamp 30 flashes when an alarm is ongoing to provide a visual indication of the alarm signal. The switches 32, 33 and 34 constitute the manually operable switch means of the container. Switches 32 and 33 are for advancing the hours and minutes respectively of the timer 22 of FIG. 5 when setting the instant or alarm times. Switch 34 controls the timer mode or, when there is an ongoing alarm signal, acts as a "snooze" control to defer the alarm for a short period of, for example, one minute.

Switches 32 and 33 are in an electrical circuit with the alarm cancellation switch 24 and timer 22 of FIG. 5, whereby the switches 32 and 33 are ineffective until the lid 12 is opened sufficiently far for the push button 27 to be released. The switch 34 also is in circuit with the alarm cancellation switch 24 whereby the function of the control button 34 when the lid 12 is closed differs from that when the lid 12 is opened, as will be described below.

The LCD display 23 normally displays the instant time in digital form. As shown in FIG. 4, there is display of "AM" or "PM" to indicate whether the time is ante meridiam or post meridiam. A diagrammatic representation 35 of an analogue clock face is provided to indicate that the display 23 is in its instant time mode. As and when alarm signals in a programmed sequence are cancelled by opening of the lid 12, the instant time mode further includes an accumulative row of squares or blocks 36 at the bottom of the display 23. Thus, before the first alarm signal is cancelled, there are no blocks 36 displayed in the instant time mode; when the lid 12 has been opened in response to the first alarm signal, the left hand of the blocks 36 is displayed; when the lid 12 has been opened in response to the second of the alarm signals, the first two left hand blocks 36 are displayed; and so on with the addition of a further block 36 for each opening of the lid 12 in response to cancellation of an alarm signal until the alarm sequence has been completed and a complete row of the blocks 36 is displayed. In the present embodiment, there is a maximum of nine alarm settings and accordingly a row of nine blocks 36.

When the lid 12 opened, a first depression of button 34 in FIG. 1 places the timer 22 of FIG. 5 in a set-time mode in which the instant time can be adjusted by pressing push buttons 32 and 33. This mode is indicated by flashing of the clock symbol 35 in FIG. 4. Subsequent depression of button 34 sets the adjusted time and moves the timer 22 to a first alarm mode indicated on the LCD display 23 by a first flashing bell 37 and by the flashing of the first block 36 in the row of indicator blocks 36. The first alarm time is set by depression of buttons 32 and 33 until the required alarm time is displayed. Subsequent depression of button 34 sets the first alarm time and moves the timer 22 into its second alarm mode. The second alarm mode is distinguished from the first alarm mode on the LCD display 23 by display of the first two of the indicator blocks 36. The alarm is set in the same manner as in the first alarm mode and the procedure continues until the required alarm sequence has been completed. As mentioned previously, there is a maximum of nine alarm settings in the sequence of the presently described container. If less than nine alarm settings are required, button 34 is pressed the requisite number of times until the ninth alarm mode is reached.

The chronological order in which alarm times are set is unimportant because the electronic timer sorts the alarm times into chronological order. Further, adjustment of the instant time leaves the alarm times unaffected. Thus, an alarm time of, say, 2 pm will remain as 2 pm local time as and when the instant time is changed on entry into another time zone.

Depression of the button 34 in the ninth alarm mode causes the LCD display 23 to automatically sequentially display the programmed alarm sequence. The displays in this sequence are distinguished from the alarm setting displays in that representation 38 of a capsule is included in the right hand corner of the display 23 in FIG. 4. After displaying the alarm sequence, the LCD display 23 returns to the normal instant time mode.

If the lid 12 is closed when the timer 22 is in a mode other then the instant time mode, depression of the push button 27 in FIG. 27 which depression occurs upon closure of the lid 12, automatically returns the timer to the instant time mode.

When the lid 12 is closed, depression of button 34 in FIG. 1 causes the LCD display 23 in FIG. 4 to automatically sequentially display the programmed alarm sequence with both the bell 37 and capsule 38 symbols and the relevant number of indicator blocks 36. An exception occurs when there is an ongoing alarm signal, in which case the button 34 acts as a snooze button to defer the alarm signal.

When there is an ongoing alarm signal, the first bell symbol 37 alternates with a second bell symbol 39 which, together with the flashing of the indicator lamp 30, provides visual indication of the alarm. The alarm cannot be cancelled until the lid 12 is opened but can be deferred by pressing push button 34. After subsequent closure of the lid 12, the relevant number of indicator blocks 36 is displayed to provide a continuous indication of the number of alarms cancelled that day in the programmed sequence. resetting the time to 0.00 while the lid 12 is open. All alarm times can be cancelled by maintaining both push buttons 32 and 33 depressed simultaneously for a period of 2 seconds immediately following depression of push button 34 with the lid 12 closed.

It will be appreciated that the invention is not restricted to the presently preferred embodiment described above and that numerous modifications and variations can be made without departing from the spirit and scope of the invention.

I claim:

1. In a timed medication container having a case with at least one medication compartment; a lid means for covering said compartment; an alarm, display means, and an electronic circuit including a timer programmable to generate alarm actuating signals at each of a plurality of alarm times and display actuating signals, an improvement characterized in that:

said display means includes means for indicating the number of times the lid means is opened in response to the alarm;

said container further includes a switch actuated by movement of the lid means between closed and open positions, said switch being in a first state when the lid means is closed and being in a second state when the lid means is open;

said electronic circuit being responsive to the switch to supply an actuating signal to the indicating means upon a change of state of the switch subsequent to the generation of an alarm signal; and said electronic circuit includes means for setting the plurality of alarm times, said setting means being operable only when the switch is in the second state.

2. The improvement according to claim 1 further characterized in that said electronic circuit includes means for sequentially displaying pre-set alarm times, said sequentially displaying means being operable only when the switch is in the second state.

3. The improvement according to claim 1 further characterized in that said electronic circuit includes means for postponing actuation of the alarm subsequent ot th generation of an alarm signal for a predetermined time interval, said actuation postponing means being operable only when the switch is in the first state.

* * * * *